United States Patent [19]

Adams, Jr.

[11] 3,974,730

[45] Aug. 17, 1976

[54] GUITAR STRUT ASSEMBLY

[76] Inventor: Andrew Borden Adams, Jr., 8700 MacArthur Blvd., Bethesda, Md. 20034

[22] Filed: Aug. 8, 1975

[21] Appl. No.: 603,031

[52] U.S. Cl. ..... 84/291

[51] Int. Cl.[2] ..... G10D 3/00; G10D 1/08

[58] Field of Search ..... 84/267, 275, 284, 291

[56] References Cited

UNITED STATES PATENTS

| | | | |
|---|---|---|---|
| 72,591 | 12/1867 | Bini | 84/291 |
| 1,183,369 | 5/1916 | Gardie | 84/291 X |
| 1,426,852 | 8/1922 | Frozeth | 84/275 |
| 1,889,408 | 11/1932 | Larson | 84/291 X |
| 3,685,385 | 8/1972 | Rendell | 84/267 |
| 3,892,159 | 7/1975 | Houtsma | 84/291 X |

*Primary Examiner*—Lawrence R. Franklin
*Attorney, Agent, or Firm*—Stevens, Davis, Miller & Mosher

[57] ABSTRACT

A guitar having a body with a pair of intersecting cross braces secured to the underside of the face thereof. A pair of struts are connected to the arms of each cross brace adjacent the sound hole in the face of the guitar. Each strut has one end connected to the arm of one of the cross braces adjacent the sound hole. Each strut extends toward the head of the body in a direction from the face toward the back. The other end of each strut is disclosed in one embodiment as connected to a vertical brace secured to the rim of the guitar. In other embodiments, the lowermost end of each strut is connected to a neck block. In a further embodiment, the lowermost end of each strut is connected to a transverse brace which is secured to the internal surface of the back of the guitar. In a still further embodiment, the struts are adjustable so that their length and position of securement on the cross brace or other parts of the body of the guitar can be varied.

21 Claims, 22 Drawing Figures

FIG. 12
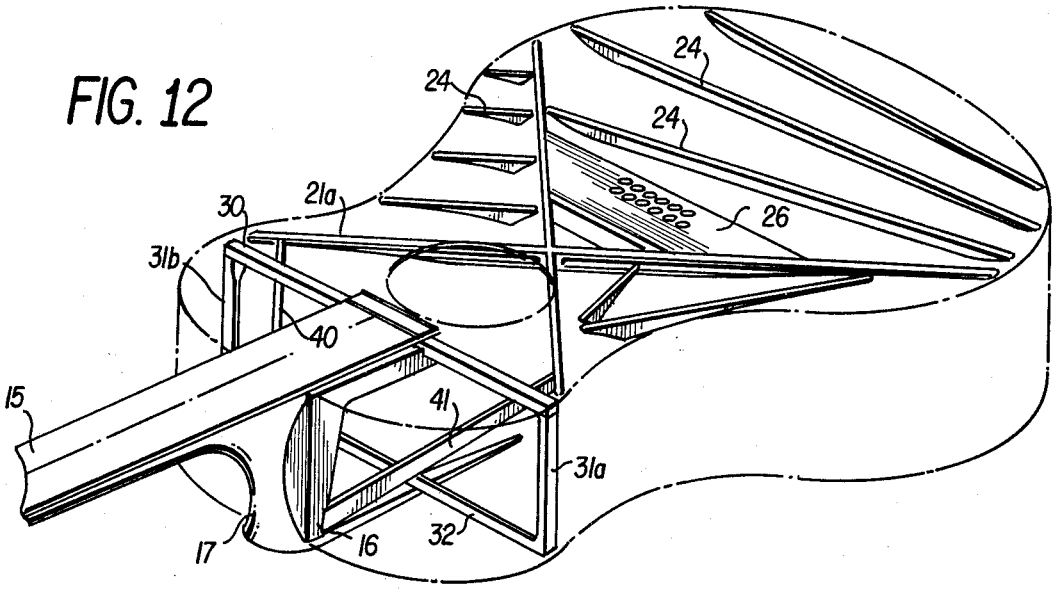
FIG. 13
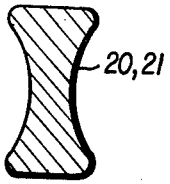
FIG. 14
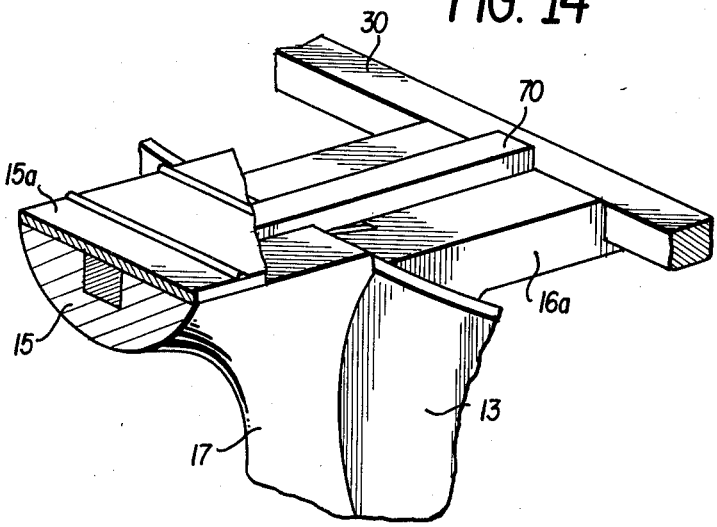
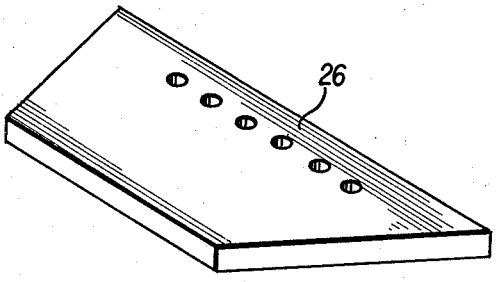
FIG. 15

FIG. 16
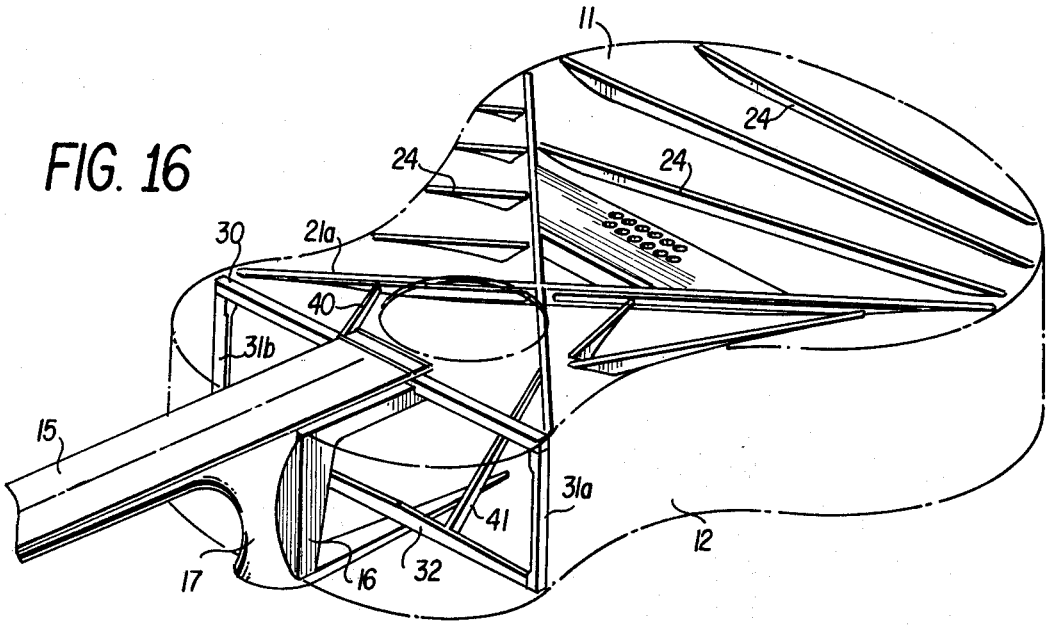
FIG. 20
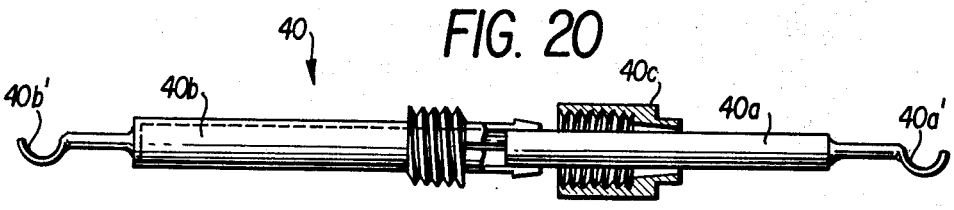
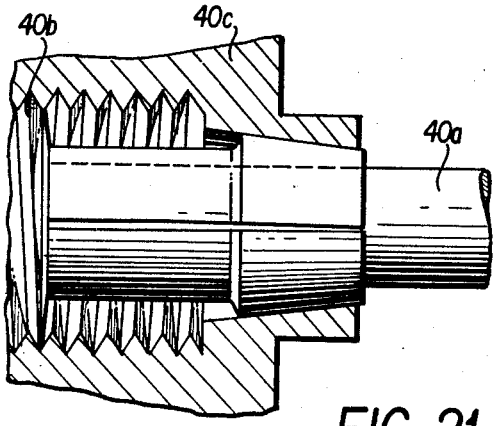
FIG. 21
FIG. 19
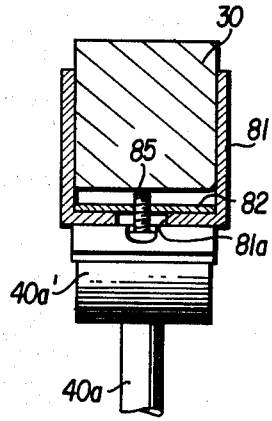

FIG. 17
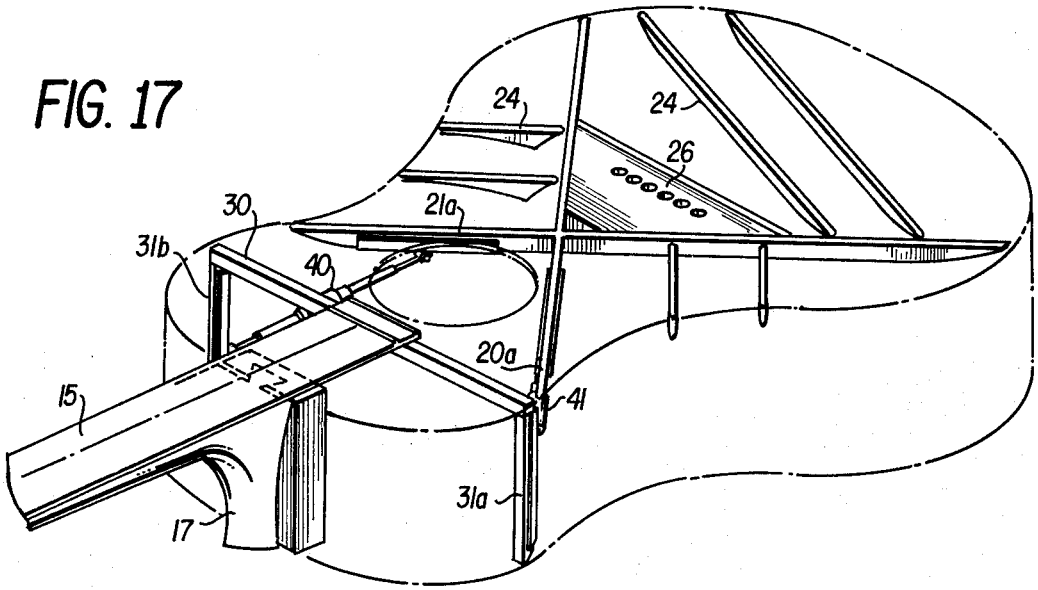
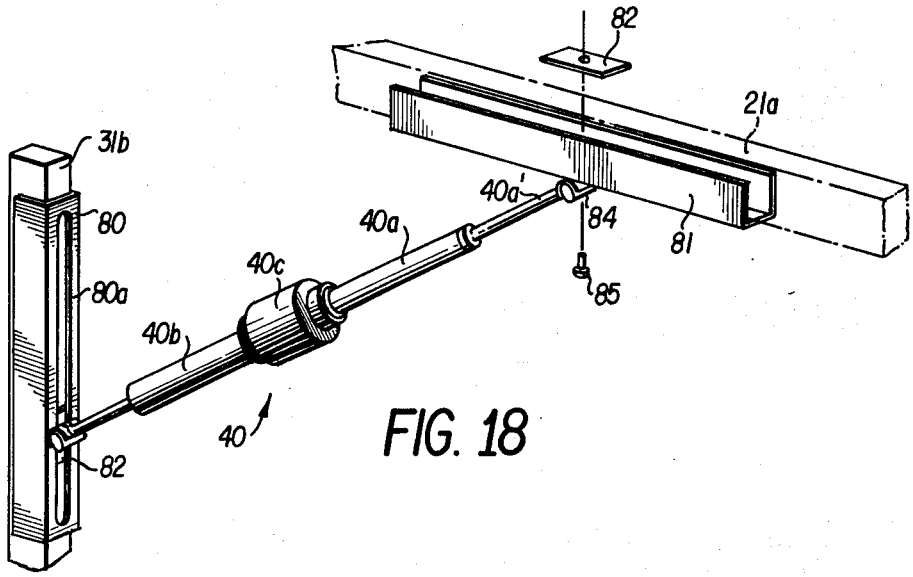
FIG. 18
FIG. 22
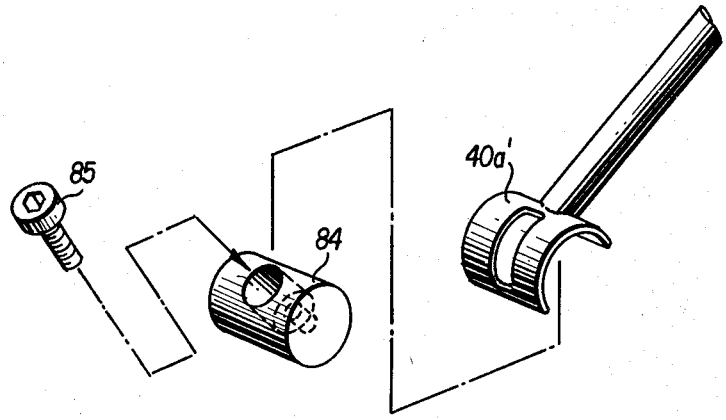

GUITAR STRUT ASSEMBLY

BACKGROUND OF THE INVENTION

1. Field of the Invention

This invention relates to guitars, and more specifically, to a strut assembly disposed within the body of guitar.

2. Prior Art

The general appearance of almost all guitars is about the same. However, the quality of sound that can be produced by what appears to be similar guitars can and do vary considerably. Many guitars tend to have poorer transient response in the lower frequency ranges than in the higher ranges, transient response being the ability to retain a desired tone when a rapid succession of notes are played. With good transient response, each note played in rapid succession is clear and well defined from that of the other notes played. Additionally, many guitars tend to lack sustain, particularly in the high range.

SUMMARY OF THE INVENTION

Applicant has found that superior transient response and sustain can be obtained, all other things being equal, when the body of the guitar is reinforced by a strut or struts secured at one end to cross braces secured to the underside of the face of the body and extending therefrom in a direction toward the head of the body and from the face toward the back and secured at their other end to another portion of the body of the guitar. Applicant has also found that particularly desirable results can be obtained when one of each strut is connected to the neck block of the guitar or to a transverse brace to the interior surface of the back of the guitar or to a vertical brace secured to the rim of the guitar.

Accordingly, it is an object of this invention to provide a guitar having improved transient response throughout the entire frequency range.

It is a further object to provide a guitar having improved sustain throughout the entire frequency range.

A still further object of this invention is to provide a guitar which will produce a sound which is extremely clear.

It is a still further object of this invention to provide a guitar having unique acoustic characteristics wherein the tones are sustained longer, where there is clearness of sound, and where the high range, low range, and middle range have improved clarity.

A still yet another object of this invention is to provide a guitar having improved amplification compatibility, particularly because of the improved transient response.

With these objects in mind, the following description, by way of nonlimiting example, is given in conjunction with the following drawings.

BRIEF DESCRIPTION OF THE DRAWINGS

FIG. 12 is a schematic view of a fourth embodiment of the invention with some parts shown in phantom;

FIG. 13 is a cross-sectional view of one of the cross braces shown in FIG. 12;

FIG. 14 is a schematic view partly in section of a portion of FIG. 12;

FIG. 15 is a schematic view of the pin plate shown in FIG. 12;

FIG. 16 is a schematic view of a fifth embodiment of the invention with some parts shown in phantom;

FIG. 17 is a schematic view of a sixth embodiment of the invention with some parts shown in phantom;

FIG. 18 is a schematic view of a portion of FIG. 17;

FIG. 19 is a cross-sectional view of a portion of FIG. 18;

FIG. 20 is a side view partly in section of the adjustable strut shown in FIG. 18;

FIG. 21 is a cross-sectional view of some of the parts of FIG. 20 shown in locking position; and FIG. 22 is a schematic view of a portion of FIG. 18 with the parts shown in the unassembled state.

DESCRIPTION OF THE PREFERRED EMBODIMENTS

Figure 1:
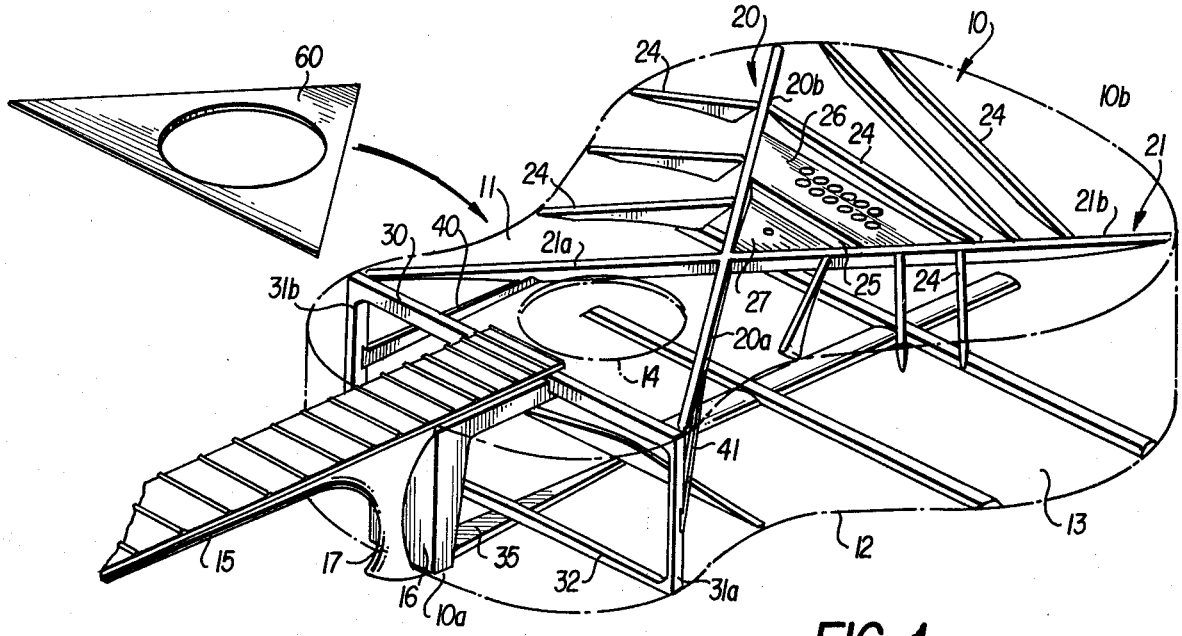
FIG. 1 is a schemetic view of a first embodiment of the invention with some parts shown in phantom and with one part shown disassembled for clarity.

The first embodiment of the guitar of this invention is shown in FIG. 1 and includes a body 10 having a sound board or face 11 which is substantially planar, i.e., substantially flat or slightly bowed in a conventional manner. The body 10 includes a head portion **10*a* and a tail portion 10*b*. A sound hole 14 is formed in conventional manner in the face 11. The body 10 also includes a sound board or back 12 spaced from the face 11 and substantially parallel thereto. The back 12, like the face 11, may be substantially flat or slightly bowed. The top and back may be made of spruce of other similar wood with the grain thereof running parallel to the longitudinal axis of the guitar. The body 10 also includes a rim 13 which together with the face 11 and back 12** define a sound box therebetween.

Figure 5:
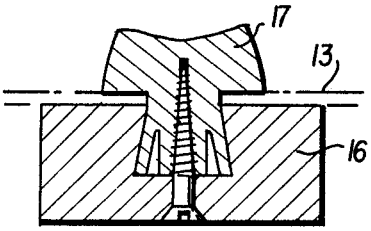
FIG. 5 is a cross-sectional view of the view of the neck heel and neck block of FIG. 1 shown in assembled relation.

The guitar also includes a neck 15 secured to the body 10. The body 10 includes a neck block 16 positioned at the head **10*a* thereof. As shown in FIG. 1, the neck 16 is substantially of inverted L-shape cross-section. The neck 15 is glued or otherwise secured to the upper surface of one leg 16*a* of the neck block 16 which is substantially parallel to the face 11. A neck support member or neck heel 17 is connected to the neck block 16 by means of a blind wedge dovetail joint. As shown in FIG. 5, the rim 13 is engaged between the neck heel 17 and the neck block 16. As in apparent from FIGS. 1 and 5, the rim 13 extends completely about the edges of the face 11 and the back 12 except for the portion thereof occupied by the neck heel 17. The blind wedge dovetail joint is locked in position by means of two screws, one of which is shown in FIG. 5. The neck heel 17 may be glued or otherwise secured to the neck 15. Alternatively, the neck 15 and heel 17** may be formed in one piece.

Glued or otherwise secured to the internal surface of the face 11 are a pair of cross braces 20, 21. The cross braces 20, 21 intersect as shown in FIG. 1 so as to form as X-shape with the arm 21*a* disposed to one side of the sound hole 14 and the arm 20*a* disposed to the other side of the sound hole 14. At their point of intersection which lies between the sound hole 14 and the tail portion 10*b*, the cross braces 20, 21 are each provided with a notch that extends half way therethrough to form a lap joint therebetween so that each of the cross braces 20, 21 is continuous. The arms 20*a*, 21*a* of the respective cross braces 20, 21 are positioned substantially symmetrically to each side of the sound hole 14 and in generally tangential relationship therewith but spaced a small distance therefrom. The arms 20*a*, 21*a* are spaced from the sound hole 14 so they cannot be easily viewed through the sound hole 14. Additional braces 24 are also glued or otherwise secured to the interior surface of the face 11 to provide support therefor in conventional manner.

Figure 2:
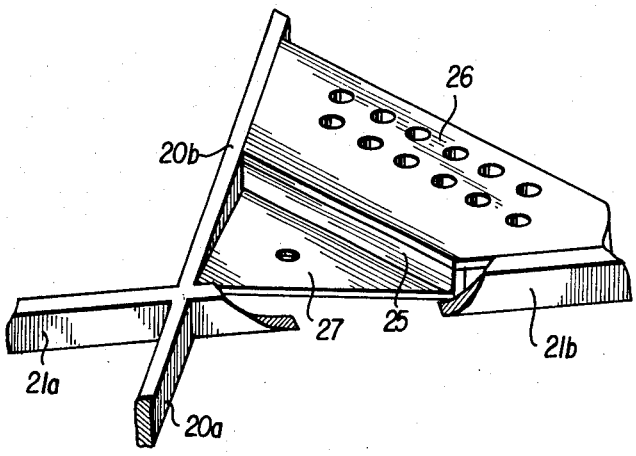
FIG. 2 is a shematic view of a detail of FIG. 1.

The body 10 also includes a transverse brace 25 glued or otherwise secured at each of its ends to the arms 20*b*, 21*b*, of the cross braces 20, 21. As shown in FIG. 2, a pin plate 26 is glued or otherwise secured to the upper edge of brace 25 as well as a portion of the arms 20*b*, 21*b*. 83 b, The pin plate 26 has a plurality of holes formed therein which are adapted to receive pins for holding the strings of the guitar. As shown in FIG. 2, the transverse brace 25 and the portions of the arms 20*b*, 21*b*, define a triangular recess in which a stiffener plate 27 is positioned. The stiffener plate 27 may be made of maple, rosewood, or other hard wood and is glued or otherwise secured to the brace 25 and the arms 20*b*, 21*b*. As shown in FIG. 2, the edge of the plate 27 most remote from the point of intersection of the braces 20, 21 is secured to the portion of the brace 25 most remote from the upper face 11. From that edge, the stiffener plate 27 extends upwardly at an angle to the point of intersection of the cross braces 20, 21 so that the corner of the stiffener plate 27 adjacent the intersection of the cross braces 20, 21 may actually contact the interior surface of the face 11 of the body 10.

A transverse brace 30 is glued or otherwise secured to the underside of interior surface of the upper face 11. As shown in FIG. 1, the transverse brace 30 is positioned between the center of the sound hole 14 and the head portion 10*a* of the body 10. The body 10 also includes a pair of vertical braces 31*a*, 31*b* glued or otherwise secured to the rim 13 at a location between the center of the sound hole 14 and the head portion 10*a*. The braces 31*a*, 31*b* are also glued or otherwise secured at their uppermost end, as shown in FIGS. 1 and 3, to the transverse brace 30.

The body 10 also includes a transverse brace 32 glued or otherwise secured to the interior surface of the back 12. The brace 32 is also glued or otherwise secured to the lowermost ends of the braces 31*a*, 31*b* so as to extend therebetween. The body 10 also includes a back axial stiffening member 35 which is glued or otherwise secured to the external surface of the back 12. The member 35 extends over and is glued or otherwise secured to the neck heel 17. As shown in FIG. 1, one end of the arm 20*a* is glued or otherwise secured to an end of the transverse brace 30 and an end of the vertical brace 31*a*. Likewise, one end of the arm 21*a* is connected to an end of the transverse brace 30 and an end of the other vertical brace 31*b*.

Figure 3:
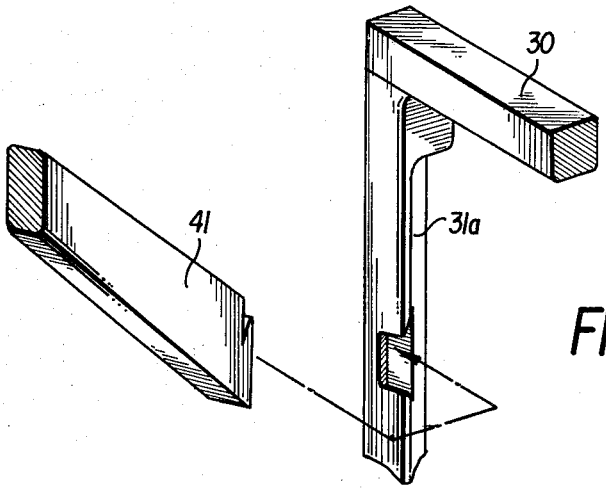
FIG. 3 is a schematic view of another portion of FIG. 1 with some parts disassembled.

As shown in FIGS. 1 and 3, a bass strut 41 is positioned between the arm 20*a* and the vertical brace 31*a*. The ends of the strut 41 are glued or otherwise secured to an intermediate portion of both the arm 20*a* and the vertical brace 31*a*. For example, as shown in FIG. 3, the lowermost end of the bass strut 41 is connected to the vertical brace 31*a* by a dovetail joint. Also, as shown in FIG. 1, a treble strut 40 is positioned between the arm 21*a* and the vertical brace 31*b*. The treble strut 40 is glued or otherwise secured to an intermediate portion of both arm 21*a* and vertical brace 31*b* in a manner similar to the securement of the bass strut 41 to the arm 20*a* and vertical brace 31*a*. Upon assembly of the treble strut 40 and the bass strut 41 into the body of the guitar, the struts 40, 41 are advantageously not preloaded but are instead loaded upon tensioning of the strings.

The body 10 also includes an anti-split plate 60 which is glued or otherwise secured to the underside of the interior surface of the face 11. The plate 60 has an aperture formed therein which corresponds in position to the sound hole 14 in the face 11. The plate 60 is made from a piece of veneer, such as mahogany, maple or similar woods, and functions to prevent splitting of the exposed end grain of the face 11 at the sound hole 14. As shown in FIG. 1, the grain of the plate 60 runs perpendicular to the longitudinal axis of the guitar and therefore perpendicular to the grain of the face 11.

Figure 6:
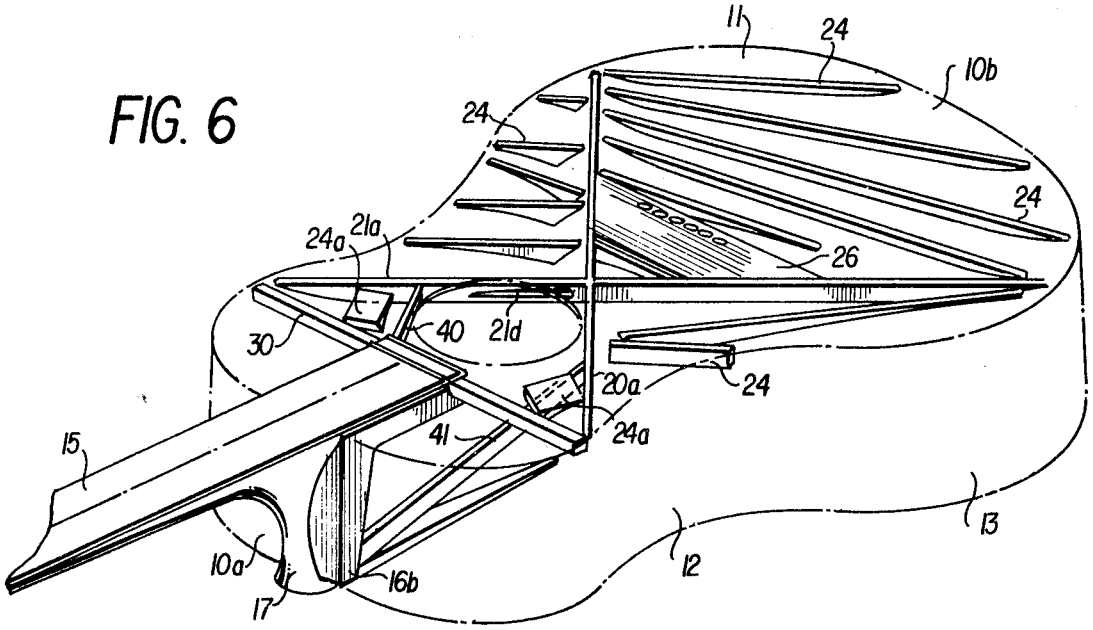
FIG. 6 is a schematic view of a second embodiment of the invention with some parts shown in phantom.
Figure 7:
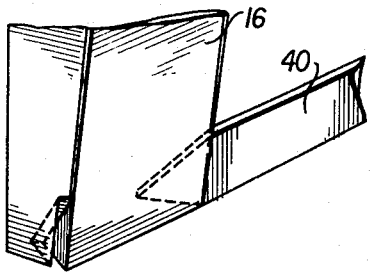
FIG. 7 is a schematic view of a portion of FIG. 6.
Figure 8:
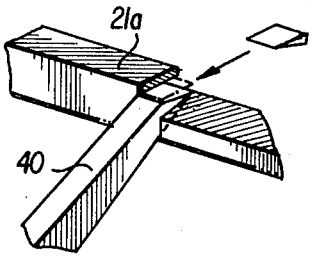
FIG. 8 is a schematic view of another portion of FIG. 6.
Figure 4:
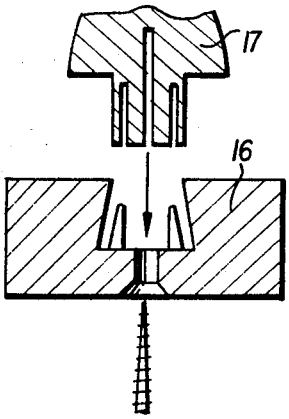
FIG. 4 is a cross-sectional view of the neck heel and neck block shown in FIG. 1 before assembly.

A second embodiment of the invention is shown in FIGS. 6 through 8. The second embodiment is in some ways similar to that of the first embodiment and, for that reason, similar or identical parts are given identical reference numerals to those applied to the first embodiment.

As shown in FIG. 6, the guitar includes a neck 15, neck heel 17, neck block 16, sound board or face 11, sound board or back 12 and rim 13. Additionally, the face 11 is reinforced by a plurality of braces 24 glued or otherwise secured to the interior surface of the face 11. The braces 24 of the FIG. 6 embodiment are similar in construction and function to those of the FIG. 1 embodiment. This embodiment also includes a pair of cross braces 20, 21. As shown at 21*d* in FIG. 6, the cross braces 20, 21 may be notched out along their length to decrease their overall mass. Also, in this embodiment, a pair of pickup mounting blocks 24*a* are glued or otherwise secured to the interior surface of the face 11 adjacent the mounting hole 14.

In the FIG. 6 embodiment, the treble strut 40 is shown having one end glued or otherwise secured to an intermediate portion of the arm 21*a*. The treble strut 40 extends from its connection to the arm 21*a* in a direction toward the head portion 10*a* and from the face 11 toward the back 12 and is connected at its other end to the bottom of the leg 16*b* of the neck block 16. The lowermost end of the treble strut 40 is connected, as shown in FIG. 7, to the neck block 16 by means of a mortice joint. The lowermost end of the treble strut 40 is secured to the neck block 16 corresponding to the side of the sound hole 14 to which the arm 21*a* is disposed and the lowermost end of the bass strut 41 is secured to the side of the neck block corresponding to the other side of the sound hole 14 to which the arm 20*a* is disposed. As shown in FIG. 8, the upper end of the treble strut 40 may be connected to the arm 21*a* by means of a wedged mortice joint. Alternatively the treble strut 40 and the bass strut 41 may be secured to an intermediate portion of the leg 16*b* of the neck block 16. Also, in this embodiment, the bass strut 41 is connected at one end to the arm 20*a* and is connected at its other end to the bottom of the leg 16*b* of the neck block 16. The bass strut 41 is connected to the arm 20*a* and the neck block 16 in a manner similar to that of the connection of the treble strut 40 to the arm 21*a* and the neck block 16. The function of the struts 40, 41 of this embodiment is similar to that of the struts 40, 41 of the first embodiment.

Figure 9:
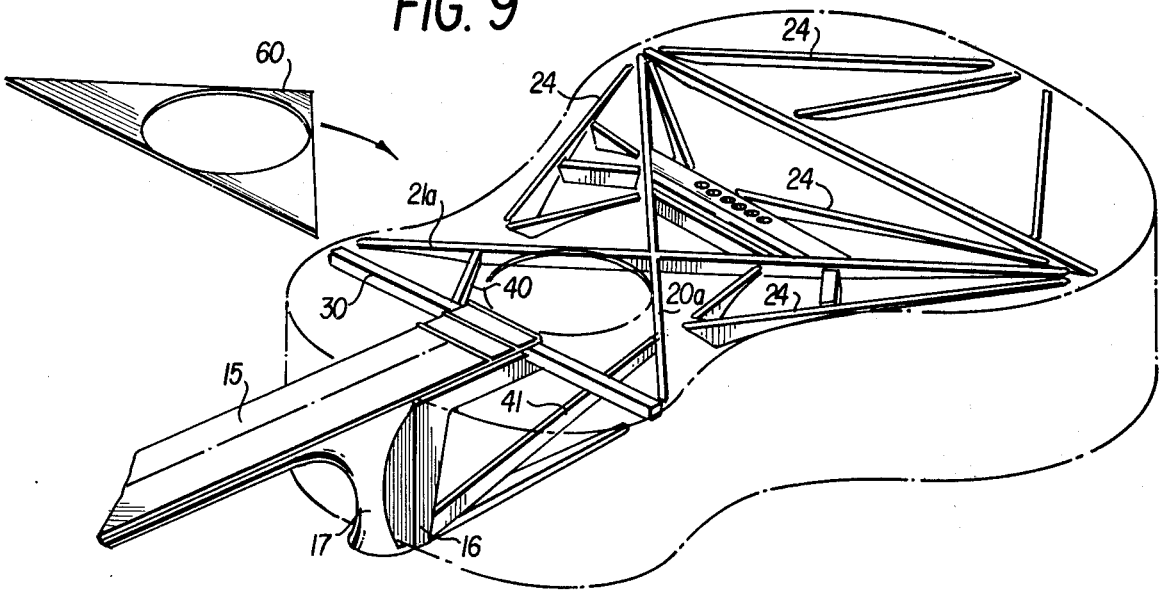
FIG. 9 is a schematic view, with some parts shown in phantom, one part shown disassembled for clarity, and the bridge not shown for clarity, of a third embodiment of the invention.
Figure 10:
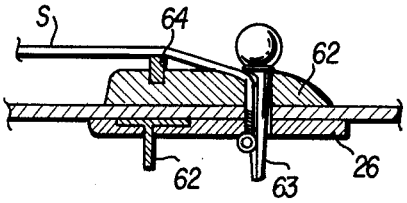
FIG. 10 is a cross-sectional view of a portion of FIG. 9.
Figure 11:
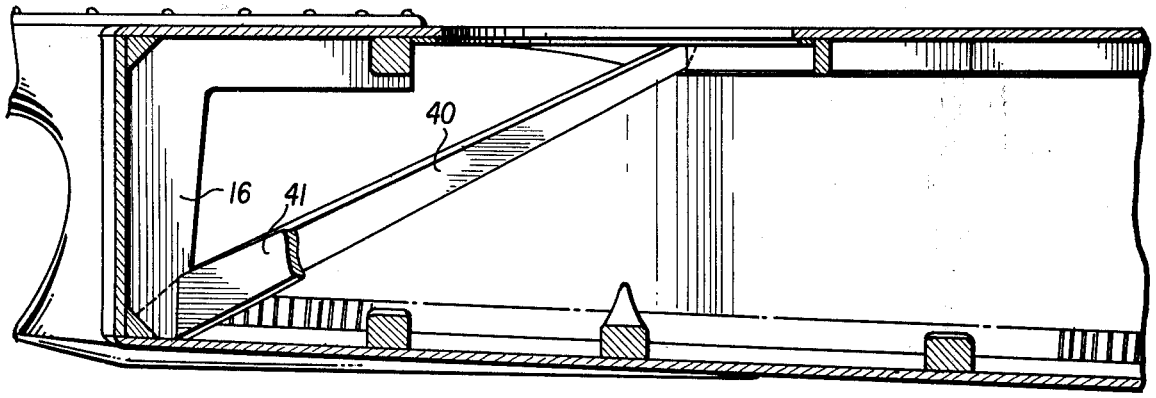
FIG. 11 is a cross-sectional view of another portion of FIG. 9.

A third embodiment of the invention is shown in FIGS. 9 through 11. Because of the similarity of this embodiment to the two previously described embodiments, identical reference numerals have been applied to the same or similar parts of the embodiments. This embodiment, like the first, includes an anti-split plate 60 which is glued to the interior surface of the face 11 of the guitar. The third embodiment, as shown in FIG. 10, also includes a pin plate 26 glued or otherwise secured to the interior surface of the face 11 of the guitar. An aluminum or other metal stiffener bar 62 is positioned in a recess in the pin plate 26. As shown in FIG. 10, the stiffener bar 62 is T-shaped in cross section and is fitted in a corresponding recess in the plate 26 so as to project from the innermost surface of the pin plate 26. A bridge 62 is positioned on the exterior surface of the face 11. A plurality of pins 63 are positioned through the apertures in the bridge 62 and the pin plate 26 and function to retain the ball ends of the string S in position. Also as shown in FIG. 10 the strings S extend over a saddle 64 seated in a recess cut in the bridge 62. The function and positioning of the treble strut 40 and bass strut 41 in this embodiment are substantially identical to those of the second FIG. 6 embodiment.

A fourth embodiment of the invention is shown in FIGS. 12 through 15. Again, parts similar or identical to those of the previous embodiments are designated in FIGS. 12 through 15 with the same reference numerals. The treble strut 40 and the bass strut 41 extend between the neck block 16 and the arms 21*a* and 20*a* respectively. The struts 40, 41 function like those of the previously described embodiments. In this embodiment, the cross-section of the cross braces 20, 21 are shown in FIG. 13. As shown in FIG. 13, the sides of the cross braces 20, 21 are incurved so as to be of considerably reduced cross-section and mass relative to that of a rectangular member having the same overall dimensions. A pin plate 26 is positioned between the cross braces 20, 21 as in previous embodiments.

As shown in FIG. 14, the neck 15, as well as a fret board 15*a* thereon, the neck heel 17, the leg 16*a* of the neck block 16 and the transverse brace 30 are interconnected by means of an axial neck reinforcing rod 70. The rod 70 functions to reinforce and rigidify the interconnection of those parts and resists warpage of the neck 15.

A fifth embodiment of the invention is shown in FIG. 16. In this embodiment, the treble strut 40 and the bass strut 41 each have one end connected to an intermediate portion of the arms 21*a*, 20*a* respectively. From their connection to the arms 21*a*, 20*a*, the struts extend in a direction toward the head portion 10*a* and in a direction from the face 11 to the back 12. The other end of the treble strut 40 is secured to a portion of the brace 32 to the same side of the body 10 in which the arm 21*a* is located. Likewise, the other end of the bass strut 41 is secured to a portion of the brace 32 to the same side of the body 10 in which the arm 20*a* is located. The struts 40, 41 are glued or otherwise secured at their ends to the transverse brace 32 and the cross braces 20, 21. The function of the treble strut 40 and the bass strut 41 of this embodiment is substantially identical to that of the other embodiments described above.

A sixth embodiment of the invention is shown in FIGS. 17 through 22. In this embodiment, the treble strut 40 and the bass strut 41 are adjustable so that their length and positions of securement to the vertical braces 31*a*, 31*b* and the arms 21*a* and 20*a* of the cross braces 20 and 21 may be varied in a manner to be subsequently described.

As shown in FIGS. 18 and 19, a channel member 80 is positioned over and fixed secured to the vertical brace 31*b*. The bottom of the channel member 80 is spaced a small distance from the corresponding surface of the vertical brace 31*b* so as to define a space between them in which can be positioned an internally threaded interior slide 82. A slot 80*a* is defined in the channel member 80 through a screw 85 to be subsequently described can extend.

Likewise, a channel member 81 is positioned over and fixedly secured to the transverse brace 21*a* with the bottom of the channel member 81 spaced a small distance from the corresponding surface of the transverse brace 21*a* to define a space between them in which can be positioned an internally threaded interior slide 82. A slot 81*a* is defined in the bottom of the channel member 81 similar to the slot 80*a* defined in the channel member 80.

As shown in FIGS. 18 and 20, the adjustable strut 40 includes a first tubular portion 40*a*, a second tubular portion 40*b*, and a tubular collet closer 40*c*. The first tubular portion 40*a* is of smaller diameter than and concentric with the second tubular portion 40*b* so as to be telescopically receivable therein. The first tubular portion 40*a* has one end which is telescopically receivable in an end of the second tubular portion 40*b* and carries at its other end a pivotable locking journal 40*a*'. The second tubular portion 40*b* is externally threaded at the end thereof which receives one end of the first tubular portion 40*a*. That end of the second tubular portion 40*b* is also formed as a collet as shown in FIGS. 20 and 21. The other end of the second tubular portion 40*b* carries a pivotable locking journal 40*b*'. The tubular collet closer 40*c*, as shown in FIG. 20, is internally threaded so as to be threadingly engageable with the external threads on the second tubular member 40*b*. The collet closer 40*c* is also internally conically flared for a reason to be subsequently described.

As shown in FIGS. 18 and 19, a thrust bearing cylinder 84 is positionable in each of the pivotable locking journals 41*a* and 40*b*'. As shown in FIG. 22, an arcuate slot is defined in the pivotable locking journal 40*a*'. A similar slot is defined in the journal 40*b*'. A hole is defined through the thrust bearing cylinder 84 and a locking screw 85 is adapted to extend through that hole. As shown in FIG. 19, the locking screw 85 extends through the hole in the thrust bearing cylinder 84, through the slot in the pivotable locking journal 40*a*' and is screwed into the internally threaded interior slide 82. By means of the screws 85, thrust bearing cylinders 84, internally threaded interior slides 82 and 82, the ends of the adjustable bass strut 40 can be fixedly secured to the vertical brace 31*b* and the transverse brace 30 in a plurality of positions.

To vary the position of the ends of the adjustable bass strut 40 on the bass strut 31*b* and the transverse strut 30, the length of the strut 40 must also be varied. This adjustment is effected by means of the collet closer 40*c* and the telescopic relation of the tubular portions 40*a* and 40*b*. To effect this adjustment, the screws 85 are partially unscrewed from the internally threaded interior slides 82 so that the ends of the strut 40 are loosely and not fixedly secured to the braces 31*b* and 21*a*. Thereafter the collet closer 40*c* is rotated so as to move from the position shown in FIG. 21 to that shown in FIG. 20. In the FIG. 20 position, the internally conically flared surface of the collet closer 40*c* does not force the collet on the end of the second tubular portion 40*b* into holding position around the exterior surface of the first tubular portion 40*a*. As a result, the first tubular portion 40*a* can be moved into or out of the second tubular portion 40*b* to adjust the length of the strut 40.

When the desired length of the strut 40 and position of the ends of the struts on the braces 31*b* and 30 is obtained, the collet closer 40*c* is returned to the position shown in FIG. 21 by tightly threading the collet closer 40*c* onto the exterior threads on the second tubular portion 40*b* so that the internally conically flared surface forces the collet into engagement with the exterior surface of the first tubular portion 40*a* and thereby fixes the length of the strut 40 by preventing relative movement of the portions 40*a* and 40*b*. Thereafter, the screws 85 are again tightly screwed into the slides 82 to fixedly secure the ends of the strut 40 in the desired position.

The bass strut 41 is likewise adjustable in the manner of the treble strut 40 just described so that the treble strut 40 and bass strut 41 can be adjustably positioned on the braces independently of each other.

It is contemplated in this invention that the adjustable struts just described can be utilized in each of the previously described embodiments.

The treble strut 40 and the bass strut 41 described in each of the embodiments above function to improve the transient response and sustain in approximately the respective treble and bass ranges. The effect caused by each of the struts does extend into the other ranges, i.e., the bass strut would have some improved effect on the treble range and the treble strut would have some improved effect on the bass range. It is therefore contemplated in this invention that a single treble or bass strut could be incorporated into a guitar.

Although a single treble or bass strut alone in a guitar may not provide the improved overall transient response and sustain of a guitar having both a treble and a bass strut therein, the provision of a single strut in the guitar body positioned in the manner described above would be advantageous and would provide some percentage of the improved response and sustain discussed above.

What I claim is:

1. A guitar comprising a body, said body comprising:
an apertured face,
a back spaced from said face,
a rim interconnecting said face and said back, and
bracing means, said bracing means comprising:
a pair of cross braces secured to the interior surface of said face and arranged as a cross with an arm of one of said cross braces disposed to one side of the aperture in said face and an arm of the other of said cross braces disposed to the other side of the aperture in said face, and the point of intersection of said cross braces lying between the aperture in said face and the tail of the body,
a first and a second substantially vertically extending brace, said first vertical brace being secured to the interior surface of the rim to one side of the body at a location between the center of the aperture in the face and the head of the body and said second vertical brace being secured to the interior surface pf the rim to the side of the body opposite said one side of said body at a location between the center of the aperture in the face and the head of the body, and
a pair of struts, one of said struts having one end thereof secured to the first vertical brace on said one said of said body and the other end thereof secured to the arm of the cross brace on that side, and the other one of said struts having one end thereof secured to the second vertical brace on said other side of said body and the other end thereof secured to the arm of the cross brace on that side.

2. A guitar as claimed in claim 1, wherein:
the positions of securement of the ends of said struts are adjustable.

3. A guitar as claimed in claim 1 wherein:
said one strut has its one end secured to an intermediate portion of said first vertical brace on said one side of said body and its other end secured to an intermediate portion of the arm of the cross brace on that side, and said other strut has its one end secured to an intermediate portion of said second vertical brace on said opposite side of said body and its other end secured to an intermediate portion of the arm of the other cross brace on that side.

4. A guitar as claimed in claim 1, wherein:
said vertical braces extend over substantially the entire width of the rim.

5. A guitar as claimed in claim 4, wherein:
said bracing means further comprises a first transverse brace secured to the interior surface of the back and directly interconnecting the pair of vertical braces.

6. A guitar as claimed in claim 5, wherein:
said bracing means further comprises a second transverse brace secured to the underside of the face and directly interconnecting the pair of vertical braces.

7. A guitar comprising a body, said body comprising:
an apertured face,
a back spaced from said face,
a rim interconnecting said face and said back,
a neck block at the head of the body,
bracing means, said bracing means comprising:
a pair of cross braces secured to the interior surface of said face and arranged as a cross with an arm of one of said cross braces disposed to one side of the aperture in said face and an arm of the other of said cross braces disposed to the other side of the aperture in said face, and the point of intersection of said cross braces lying between the aperture in said face and the tail of the body, and a pair of struts, one of said struts having one end thereof secured to the neck block and the other end thereof secured to the arm of the cross brace disposed to one side of the aperture, and the other one of the struts having one end thereof secured to the neck block and the other end thereof secured to the arm of the cross brace disposed to the other side of the aperture in said face.

8. A guitar as claimed in claim 7, wherein:

the positions of securement of the ends of the struts are adjustable.

9. A guitar as claimed in claim 7, wherein:

said one strut has its other end secured to an intermediate portion of the arm of the cross brace disposed to one side of the aperture in said face, and the other one of said struts has its other end secured to an intermediate portion of the arm of the cross brace disposed to the other side of the aperture in said face.

10. A guitar as claimed in claim 9, wherein:

the one end of each of said struts is secured to the end of the neck block closest to said back.

11. A guitar as claimed in claim 10, wherein:

the one end of said one strut is secured to the side of the neck block corresponding to said one side of said aperture, and the one end of said other strut is secured to the side of the neck block corresponding to said other side of said aperture.

12. A guitar comprising a body, said body comprising:

an apertured face, a back spaced from said face, a rim interconnecting said face and said back, and bracing means, said bracing means comprising:

a pair of cross braces secured to the interior surface of said face and arranged as a cross with an arm of one of said cross braces disposed to one side of the aperture in said face and an arm of the other of said cross braces disposed to the other side of the aperture in said face, and the point of intersection of said cross braces lying between the aperture in said face and the tail of the body, a transverse brace secured to the interior surface of the back at a location between the head of the body and a portion of the back lying in a plane, substantially perpendicular to the back, through the center of aperture in the face, and a pair of struts having one end thereof secured to the transverse brace and the other end thereof secured to the arm of the cross brace disposed to one side of the aperture in said face, and the other one of said struts having one end thereof secured to the transverse brace and the other end thereof secured to the arm of the cross brace disposed to the other side of the aperture in said face.

13. A guitar as claimed in claim 12, wherein:

the positions of securement of the ends of the struts are adjustable.

14. A guitar as claimed in claim 12, wherein:

said one strut has its other end secured to an intermediate portion of the arm of the cross brace disposed to one side of the aperture in said face, and the other one of said struts has its other end secured to an intermediate portion of the arm of the cross brace disposed to the other side of the aperture in said face.

15. A guitar a claimed in claim 14, wherein:

said one strut has its one end secured to a portion of said transverse brace to the same side of the body as said one side of the aperture in said face, and the other one of said struts has its one end secured to a portion of said transverse brace to the same side of the body as said other side of the aperture in said face.

16. A guitar as claimed in claim 12, wherein:

said transverse brace extends completely across the interior surface of said back, and said bracing means further comprises a first and a second substantially vertically extending brace secured to the rim, each of said vertically extending braces having one end secured to a respective end of the transverse brace.

17. A guitar as claimed in claim 16, wherein:

said bracing means further comprises a second transverse brace secured to the underside of the face and extending completely thereacross, and the other end of each of said vertical braces is secured to a respective end of the second transverse brace.

18. A guitar comprising a body, said body comprising:

an apertured face, a back spaced from said face, a rim interconnecting said face and said back, and bracing means, said bracing means comprising:

a pair of cross braces secured to the interior surface of said face and arranged as a cross with an arm of one of said cross braces disposed to one side of the aperture in said face and an arm of the other of said cross braces disposed to the other side of the aperture in said face, and the point of intersection of said cross braces lying between the aperture in said face and the tail of the body, and a pair of struts, one of said struts having one end thereof secured to the arm of the cross brace disposed to one side of the aperture in said face, said one strut extending from its securement at its one end in a direction toward the head of the body and from said face toward said back, and having the other end thereof secured to the body, the other of said struts having one end thereof secured to the arm of the cross brace disposed to the other side of the aperture in said face, said other strut extending from its securement at its one end in a direction toward the head of the body and from said face toward said back and having the other end thereof secured to the body.

19. A guitar as claimed in claim 18, wherein:

said one strut has its one end connected to an intermediate portion of the arm of the cross brace disposed to one side of the aperture in said face, and said other strut has its one end connected to an intermediate portion of the arm of the cross brace disposed to the other side of the aperture in said face.

20. A guitar comprising a body, said body comprising:

an apertured face, a back spaced from said face, a rim interconnecting said face and said back, and bracing means, said bracing means comprising:

a pair of cross braces secured to the interior surface of said face and arranged as a cross with an arm of one of said cross braces disposed to one side of the aperture in said face and an arm of the other of said cross braces disposed to the other side of the aperture in said face, and the point of intersection of said cross braces lying between the aperture in said face and the tail of the body, and at least one strut, said strut having one end secured to the arm of one of the cross braces, said strut extending from its securement at its one end in a direction toward the head of the body and from said face toward said back and having the other end thereof secured to the body.

21. A guitar as claimed in claim 20, wherein:

said strut has its one end connected to an intermediate portion of the arm of said one cross brace.

* * * * *